US005174572A

United States Patent [19]

Ho

[11] Patent Number: 5,174,572

[45] Date of Patent: Dec. 29, 1992

[54] GOLF CLUB HAVING A POSITION INDICATOR MOUNTED THERETO

[76] Inventor: Chin L. Ho, No. 59, Wu Chuan 3rd Road, Wu Ku Industry District, Taipei County, Taiwan

[21] Appl. No.: 904,131

[22] Filed: Jun. 25, 1992

[51] Int. Cl.[5] ..... A63B 69/36; A63B 53/14; G01C 9/28

[52] U.S. Cl. ..... 273/162 B; 33/334; 33/373; 33/390; 33/384

[58] Field of Search ..... 273/162 B, 32 B, 32 H, 273/32 R, 162 R, 183 D, 164, 163 R, 163 A; 33/370, 508, 334, 373, 390, 384, 389

[56] References Cited

U.S. PATENT DOCUMENTS 4,079,520 3/1978 Davis ..... 273/162 B X
4,482,155 11/1984 Higley ..... 273/162 B

*Primary Examiner*—George J. Marlo
*Attorney, Agent, or Firm*—Sughrue, Mion, Zinn, Macpeak and Seas

[57] ABSTRACT

A golf club includes a shaft and a rubber mounting seat which is provided on the shaft. The mounting seat confines a blind bore with a hemispherical bottom and has an open top end and an annular flange which projects inwardly from the open top end. A position indicator is received in the blind bore and includes a cylinder body which has a hemispherical bottom, a top end that is formed with a fluid cavity and a window that covers the fluid cavity. The window has a position marker formed thereon. The fluid cavity contains a volume of liquid therein. The liquid forms a positioning bubble beneath the window. The hemispherical bottom of the cylinder body extends into and is in frictional contact with the hemispherical bottom of the blind bore to permit tilting and rotative adjustments of the cylinder body within the blind bore. The cylinder body is initially adjusted so as to move the position marker to a desired position which corresponds to an optimum golf club striking position of a golfer. The golf club is then adjustably inclined during succeeding use so as to align the positioning bubble with the position marker.

6 Claims, 4 Drawing Sheets

GOLF CLUB HAVING A POSITION INDICATOR MOUNTED THERETO

BACKGROUND OF THE INVENTION

1. Field of the Invention

The invention relates to a golf club, more particularly to a golf club having a position indicator mounted thereto to guide correction of the inclination of the golf club so as to facilitate finding the optimum golf club striking position of a golfer.

2. Description of the Related Art

As the popularity of golf increases worldwide, the number of people wanting to learn to play golf similarly increases. However, a golf course can accommodate only a limited number of golfers at a single time. Furthermore, in order to acquire the required skill to play golf properly, many days of practice are needed. This is impractical for a would-be student who has no time to spend each day on a golf course or in a driving range in order to learn how to properly handle the golf club and how to strike the ball for different distances.

In conventional golf, the optimum golf club striking position depends upon the required ball distance, the height of the golfer and the type of golf club in use. Adjustments to the position of the golf club relative to the golf ball are usually made according to the naked eye. Since there is no basis for comparing a former golf club striking position with the present golf club striking position, a golfer has no way of determining whether the golf club should be shifted to the left or right or whether the height of the golf club should be adjusted. Thus, continuous practice is needed before the golfer can accurately strike the ball for different distances. For long distances, such as 200 meters, the inclination of the golf club is important so as to obtain the maximum distance for a single stroke. A student golfer thus spends a lot of time looking for the optimum golf club striking position in order to reach his objective of maximum range. As a consequence, golf is often referred to as a rich man's sport because of the huge amount of time and money spent in learning golf.

Presently, various devices are installed on a golf club in order to assist the golfer in properly positioning the same. U.S. Pat. No. 4,482,155 discloses a bubble level indicator which is attached to the handle grip end of a golf club. U.S. Pat. Nos. 2,976,046, 3,429,576 and 4,902,014 disclose a spirit level indicator which is mounted on the head of a golf club. Note that the level indicators in the above-cited references are mounted fixedly on the golf club, and thus, adjustments in the position of the level indicators are not possible. A golfer should therefore recall the position of a bubble in the level indicator relative to a position marker on the same when finding the optimum golf club striking position.

A position indicator which is detachably mounted on a golf club has been disclosed in U.S. Pat. No. 4,079,520. Referring to FIGS. 1 and 2, the position indicator includes a clamp (b) for securing a boss (b1) on the shaft (a) of a golf club. The boss (b1) receives a level indicator (c). The connection between the boss (b1) and the level indicator (c) is a ball and socket type joint to permit tipping and rotative adjustments of the level indicator (c) upon the boss (b1). A lock screw (d) is provided to lock the level indicator (c) upon the boss (b1) in a position which corresponds to the optimum golf club striking position. Repeated proper positioning of the golf club can be quickly achieved by aligning a bubble in the level indicator (c) with a position marker on the same.

The main drawbacks of the above-described position indicator are as follows:

1. Installation of the position indicator can cause a substantial increase in the cost of the golf club because of the number of components thereof.

2. Repeated initial adjustments in the position of the level indicator (c) upon the boss (b1) should be conducted when finding the optimum golf club striking position. Such adjustments are relatively inconvenient to accomplish and are time-consuming because a lock screw (d) is used to lock the level indicator (c) in a position which corresponds to the optimum golf club striking position.

Other types of conventional level indicators which can be detached from the golf club are disclosed in U.S. Pat. Nos. 4,934,706 and 4,977,680.

SUMMARY OF THE INVENTION

Therefore, the main objective of the present invention is to provide a golf club having a position indicator mounted thereto. The position indicator can be easily installed and adjusted and is used to guide correction of the inclination of the golf club so as to facilitate finding the optimum golf club striking position of a golfer.

Accordingly, the preferred embodiment of a golf club of the present invention comprises:

a shaft;

a rubber mounting seat provided on the shaft, said mounting seat confining a blind bore with a hemispherical bottom and having an open top end and an annular flange which projects inwardly from the open top end; and a position indicator including a cylinder body with a hemispherical bottom, said cylinder body having a top end which is formed with a fluid cavity and a window that covers the fluid cavity, said window having a position marker formed thereon, said fluid cavity containing a volume of liquid therein, said liquid forming a positioning bubble beneath the window, said cylinder body being received in the blind bore such that the hemispherical bottom of the cylinder body extends into and is in frictional contact with the hemispherical bottom of the blind bore to permit tilting and rotative adjustments of the cylinder body within the blind bore.

The cylinder body is initially adjusted so as to move the position marker to a desired position which corresponds to an optimum golf club striking position of a golfer. The golf club is then adjustably inclined during succeeding use so as to align the positioning bubble with the position marker.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
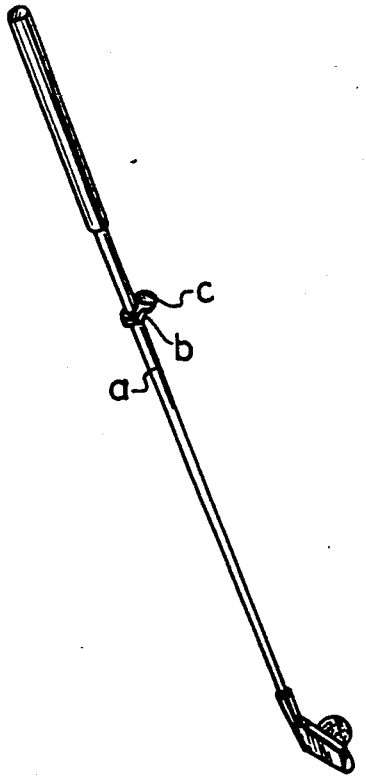
FIG. 1 PRIOR ART
FIG. 1 is an illustration of a conventional golf club which incorporates a position indicator as disclosed in U.S. Pat. No. 4,079,520.
Figure 2:
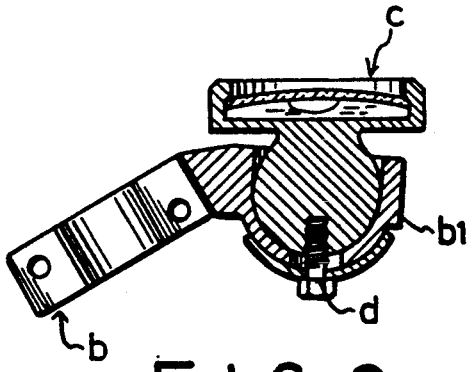
FIG. 2 PRIOR ART
FIG. 2 is a sectional view of the position indicator shown in FIG. 1.
Figure 3:
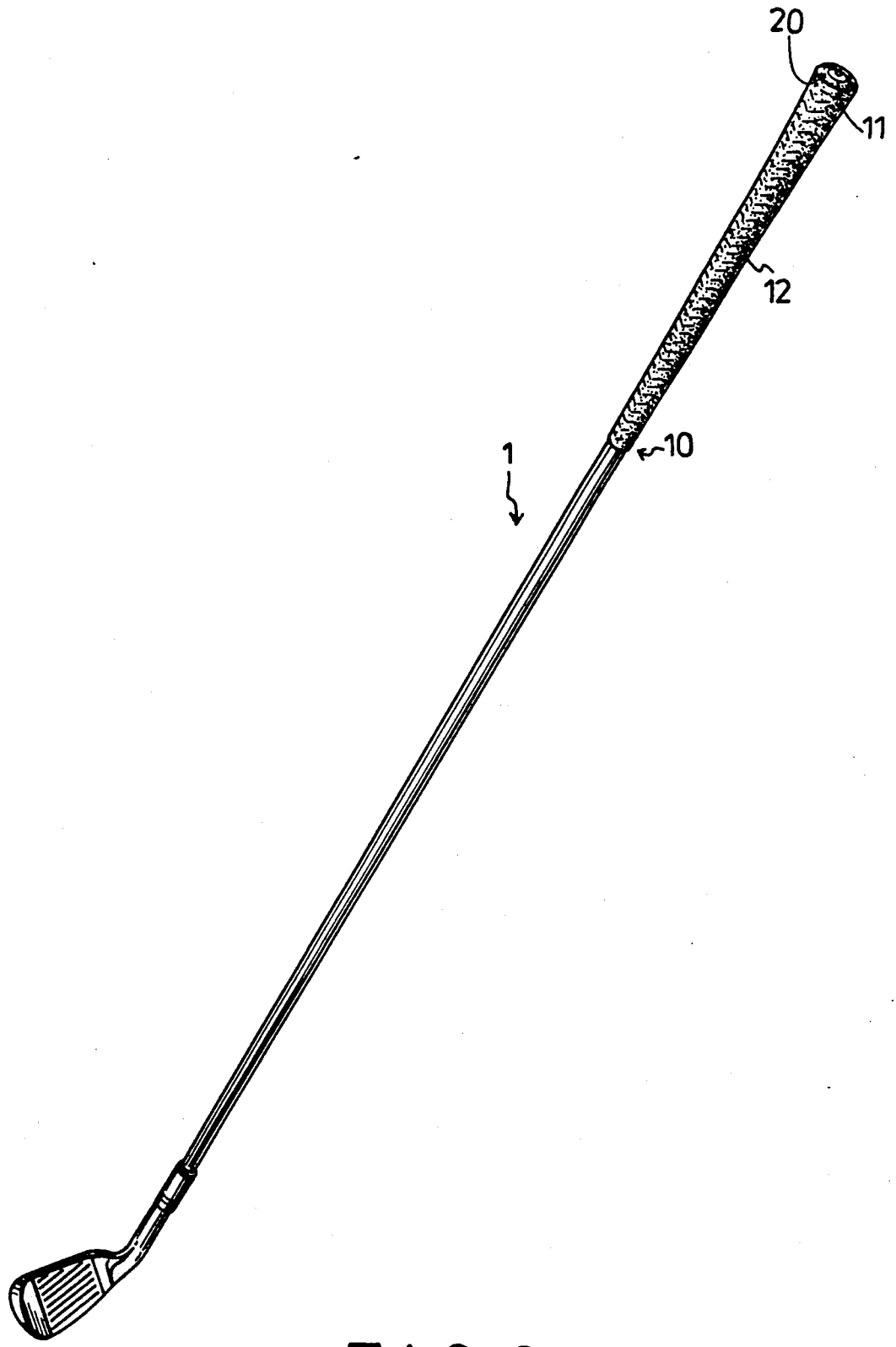
FIG. 3 is an illustration of the first preferred embodiment of a golf club according to the present invention.
Figure 4:
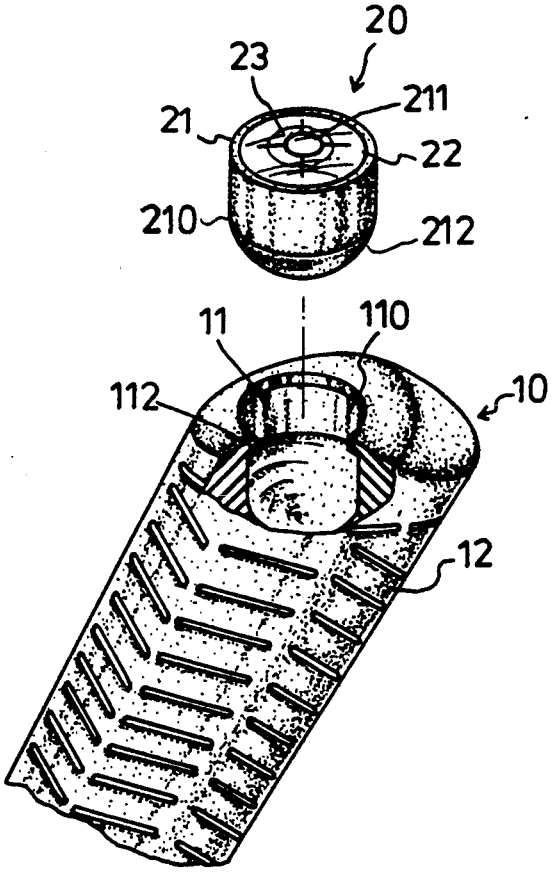
FIG. 4 is an exploded fragmentary view of the first preferred embodiment to illustrate a position indicator thereof.

Referring to FIGS. 3 and 4, the first preferred embodiment of a golf club (1) according to the present invention is shown to comprise a shaft (10) and a position indicator (20).

The golf club (1) is of a conventional type and the construction thereof will not be described in great detail. The shaft (10) has a top end which is provided with a rubber handle sleeve (12). A mounting seat (11) is formed on a distal closed end of the handle sleeve (12). Providing the mounting seat (11) on the handle sleeve (12) obviates the need for conducting a metal forming step on the shaft (10). The mounting seat (11) confines a blind bore (110) which has a hemispherical bottom (111). The mounting seat (11) further has an annular flange (112) which projects inwardly from an open top end of the same. Note that the axis of the blind bore (110) is preferably inclined relative to the axis of the shaft (10). This permits the axis of the blind bore (110) to be positioned closer to a true vertical axis when the golf club (1) is in use.

The position indicator (20) includes a cylinder body (210) with a hemispherical bottom (212). The cylinder body (10) has a top end which is formed with a fluid cavity that contains a volume of liquid (22), such as water, therein and a window (21) which covers the fluid cavity and which has a circular position marker (211) formed thereon. The liquid (22) forms a positioning bubble (23) beneath the window (21). The positioning bubble (23) is always maintained at a topmost level of the cylinder body (210) regardless of its orientation.

To assemble the first preferred embodiment, the cylinder body (210) is forced into the blind bore (110) and is retained therein by means of the annular flange (112). The hemispherical bottom (212) of the cylinder body (210) extends into and is in frictional contact with the hemispherical bottom (111) of the blind bore (110), thereby permitting tilting and rotative adjustments of the cylinder body (210) within the blind bore (110).

When using the first preferred embodiment, the inclination of the golf club (1) is first adjusted until the golfer has found his optimum golf club striking position. Since the inclination of the golf club (1) has been changed, the position of the bubble (23) relative to the position marker (23) similarly changes. The golfer then adjusts the position of the cylinder body (210) within the blind bore (110) by applying pressure on the top end of the cylinder body (210) so as to cause the cylinder body (210) to pivot and permit alignment of the position marker (211) with the positioning bubble (23) once the golfer has found the optimum golf club striking position. During succeeding use of the golf club (1), the inclination of the golf club (1) is simply adjusted until the positioning bubble (23) coincides with the shifted position marker (211). The present invention thus facilitates the positioning of the golf club (i) to the golfer's optimum golf club striking position.

Figure 5A:
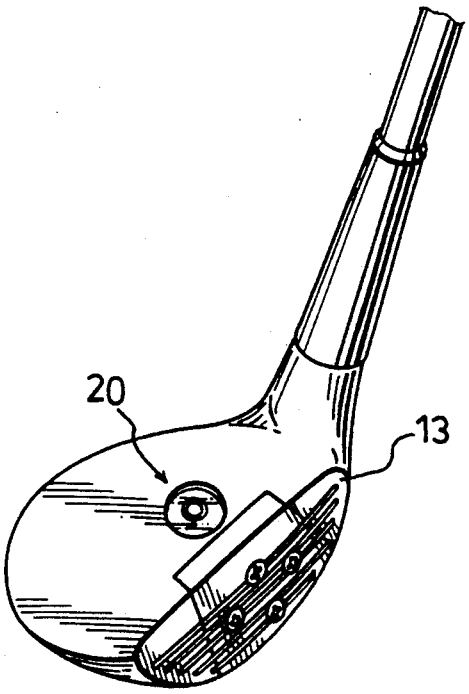
FIGS. 5A and 5B are illustrative examples of a golf head of the second preferred embodiment of a golf club according to the present invention.
Figure 5B:
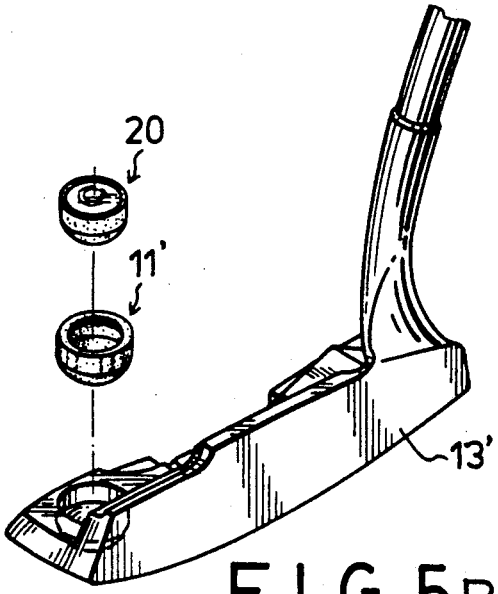

The position indicator (20) can be placed at any position on the golf club (1). FIGS. 5A and 5B are illustrative examples of the second preferred embodiment of a golf club according to the present invention. In the second preferred embodiment, the rubber mounting seat (11') is mounted on a golf head (13, 13') which is provided on a lower end of the shaft of a golf club. The position indicator (20) is tiltably and rotatably received in the mounting seat (11'). The operation of the second preferred embodiment is similar to that of the first preferred embodiment and will not be detailed herein. The configurations of the golf heads (13, 13') are conventional and will not be described further.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A golf club, comprising:

a shaft with a top end and a lower end which is provided with a golf head;

a rubber mounting seat provided on said club, said mounting seat confining a blind bore with a hemispherical bottom and having an open top end and an annular flange which projects inwardly from said open top end; and a position indicator including a cylinder body with a hemispherical bottom, said cylinder body having a top end which is formed with a fluid cavity and a window that covers said fluid cavity, said window having a position marker formed thereon, said fluid cavity containing a volume of liquid therein, said liquid forming a positioning bubble beneath said window; said cylinder body being received in said blind bore such that said hemispherical bottom of said cylinder body extends into and is in frictional contact with said hemispherical bottom of said blind bore to permit tilting and rotative adjustments of said cylinder body within said blind bore;

said cylinder body being initially adjusted so as to move said position marker to a desired position which corresponds to an optimum golf club striking position of a golfer, said golf club being adjustably inclined during succeeding use so as to align said positioning bubble with said position marker.

2. The golf club as claimed in claim 1, wherein said top end of said shaft is provided with a rubber handle sleeve which has a distal closed end, said mounting seat being formed on said distal closed end of said handle sleeve.

3. The golf club as claimed in claim 2, wherein said blind bore has an axis which is inclined relative to a longitudinal axis of said shaft, thereby permitting the axis of said blind bore to be positioned closer to a true vertical axis when said golf club is in use.

4. The golf club as claimed in claim 1, wherein said position marker is a circular target.

5. The golf club as claimed in claim 1, wherein said liquid is water.

6. The golf club as claimed in claim 1, wherein said mounting seat is mounted on said golf head.

* * * * *